US005740619A

United States Patent [19]

Broder

[11] Patent Number: 5,740,619

[45] Date of Patent: Apr. 21, 1998

[54] RETRACTABLE STUD

[76] Inventor: Morris H. Broder, 701-160 Tuxedo Avenue, Wpg, Canada, R3P 1B2

[21] Appl. No.: 931,576

[22] Filed: Sep. 16, 1997

Related U.S. Application Data

[60] Continuation of Ser. No. 349,422, Dec. 5, 1994, abandoned, which is a division of Ser. No. 215,640, Mar. 22, 1994, abandoned.

[51] Int. Cl.[6] ..... A43C 15/00

[52] U.S. Cl. ..... 36/61; 36/29

[58] Field of Search ..... 36/61, 127, 29

[56] References Cited

U.S. PATENT DOCUMENTS 4,873,774 10/1989 Lafever ..... 36/61

5,299,369 4/1994 Goldman ..... 36/61

5,526,589 6/1996 Jordan ..... 36/134

*Primary Examiner*—Ted Kavanaugh

[57] ABSTRACT

A retractable stud for a footgear sole carried by a movable backing plate having a underlying air inflatable and air deflatable bladder with means for air inflation and air deflation which in turn has an underlying footgear outer sole having a bottom outer surface defining an opening for passage of the retractable stud, the bladder in an air inflated configuration moving the backing plate inboard thus holding the stud against the weight of the wearer of the sole in a retracted position entirely within the bottom outer surface of the outer sole, the bladder in an air exhausted deflated configuration allowing the weight of the wearer of the sole to move the backing plate outboard thus holding the stud in a protruding position beyond the bottom outer surface of the outer sole.

1 Claim, 1 Drawing Sheet

RETRACTABLE STUD

CROSS-REFERENCE TO RELATED APPLICATIONS

This is a continuation of U.S. Ser. No. 08/349,422, filing date Dec. 5, 1994, now abandoned which is a divisional application of Ser. No. 08/215,640, filing date Mar. 22, 1994, now abandoned, setting forth details of a patentably distinct species of the invention as set forth in that application.

The invention relates to improvements in ambient surface gripping means for footgear, including athletic/jogging footwear.

SUMMARY OF THE INVENTION

A considerable difficulty encountered by many with existing jogging footwear during differing seasons of the year, is the differing surface friction conditions. A winter outdoor run may encounter dry asphalt or concrete, or glare ice or snow.

It is an object of the present invention to provide means whereby a jogger may, while jogging, change the gripping action of a jogging shoe to match varying terrain conditions as encountered.

Greater stability and better balance may be achieved by having a retractable stud as part of the underside terrain contacting surface of jogging footwear, so that a jogger may, while jogging, adjust for terrain conditions as encountered.

The novel retractable stud of the invention may take the form of a stud/spike means adapted to move into and out of a jogging shoe outer sole. An air bladder similar in shape to a hollow candy lifesaver adapted to be pressurized and/or depressurized is mounted beneath the stud/spike means. A change in pneumatic pressure changes the amount by which the end of the stud/spike means is allowed to move outside of the jogging shoe sole.

Additional objects and advantages, if not specifically set out, will become apparent during the course of the following disclosure.

The invention accordingly comprises the novel means, exemplified in the following detailed disclosure and fairly coming within scope of the accompanying claims, by which improved grip on ambient terrain can be achieved by an adjustable stud/spike means co-acting with an air bladder means, as well as devices or components of devices possessing the novel features, constructions, combination or relation of components or elements also exemplified in the following detailed disclosure and also fairly coming within the scope of the accompanying claims.

BRIEF DESCRIPTION OF THE DRAWING

For a fuller understanding of the nature and objects of the invention, reference should be had to the following detailed description taken in connection with the accompanying non-limiting examples of embodiments of the invention, which have been chosen for illustrative purposes only, and which are shown in the accompanying drawing, wherein.

DESCRIPTION OF THE PREFERRED EMBODIMENT

Figure 1:
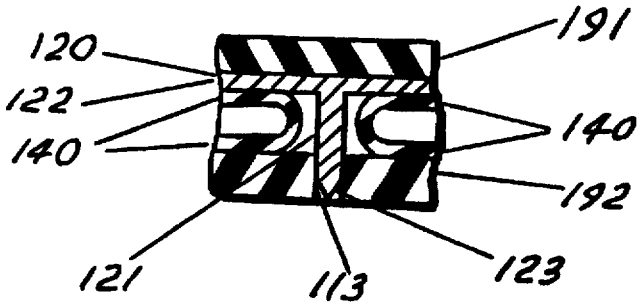
FIG. 1 is a sectional view illustrating a preferred embodiment of the invention.

Referring now to FIG. 1, there is shown in sectional view a preferred embodiment of the invention. The numeral 120 designates a retractable stud/spike means having a spike 121, a backing plate 122, and a pointed end 123 of spike means 121. The numeral 140 designates an air bladder adapted to be pressurized and/or depressurized. The numeral 191 designates a portion of a jogging shoe inner sole. The numeral 192 designates a portion of a jogging shoe outer sole. The numeral 113 designates a passageway in outer sole 192 which permits the movement of stud 121 through outer sole 192, and which snugly fits about stud 121. Air bladder 140 is shown in pressurized position in FIG. 1, corresponding to retracted position of stud 121.

Figure 2:
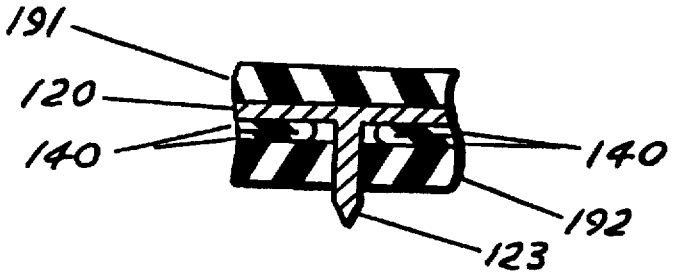
FIG. 2 is a sectional view illustrating the same preferred embodiment of the invention as shown in FIG. 1 showing a change in the juxtaposition of the parts as shown in FIG. 1.

Referring now to FIG. 2, there is shown a sectional view illustrating the same preferred embodiment of the invention as shown in FIG. 1 showing a change in the juxtaposition of the parts as shown in FIG. 1. The juxtaposition of the parts in FIG. 2 illustrates the depressurized position of air bladder 140 corresponding to the protruding position of spike 121 through outer sole 192 of an athletic/jogging footgear.

Figure 3:
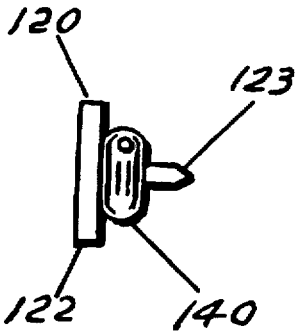
FIG. 3 is a left side elevation view of preferred embodiment parts as shown in plan view in FIG. 4 showing a juxtaposition of preferred embodiment parts.
Figure 4:
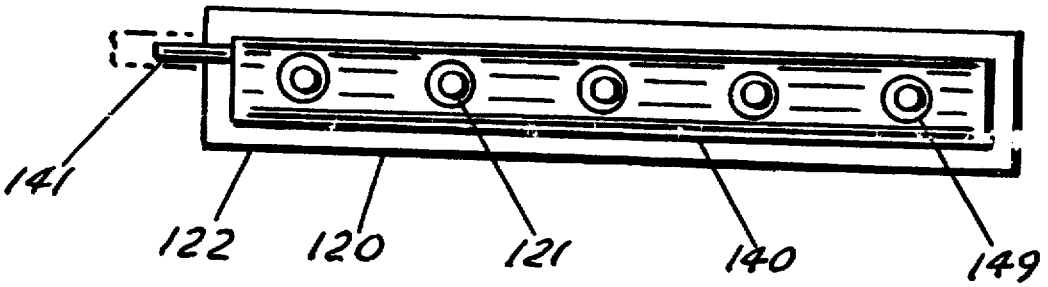
FIG. 4 is a plan view of preferred embodiment parts shown in left side elevation view in FIG. 3.

Referring now to FIG. 3, there is shown a left side elevation view of preferred embodiment parts as shown in plan view in FIG. 4 showing a juxtaposition of preferred embodiment parts. The numeral 120 designates a retractable stud/spike means having a backing plate 122 and a spike having a pointed end 123. The numeral 140 designates an air bladder adapted to be pressurized and/or depressurized.

Referring now to FIG. 4, there is shown a plan view of preferred embodiment parts shown in left side elevation view in FIG. 3, showing a juxtaposition of preferred embodiment parts. The numeral 120 designates a retractable stud/spike means having a spike means 121 and a backing plate means 122. The numeral 140 designates an air bladder adapted to be pressurized and/or depressurized, having sealed circular passageways 149 adapted to permit the movement of stud/spike means 121 through air bladder 140 without the loss of pressurization from air bladder 140, and a hollow tube means 141 adapted to permit the passage of air into and out of air bladder 140. A method of attachment of tube means 141 to a supply exhaust tube connected to a pneumatic valve is shown in reference lines.

In donning joggers for an outdoor run, a small hand pump may be used in connection with a pneumatic valve incorporated into each jogger, and connected to a hollow tube means 141, to pressurize air bladder 140 into a configuration similar to that illustrated in FIG. 1 and FIG. 3.

As illustrated in FIG. 1, as pressurized, air bladder means 140 holds backing plate means 122 sufficiently away from athletic/jogger outer sole 192 so that point 123 of stud means 121 is held entirely within outer sole 192.

Upon encountering glare ice, the pneumatic valve is actuated to depressurize air bladder means 140.

As depressurized, as shown in FIG. 2, the weight of the wearer of the athletic/jogger causes inner sole 191 to move towards outer sole 192, squeezing empty air bladder means 140 in the compressed position illustrated, forcing pointed end 123 of the stud means to protrude outboard of outer sole 192.

Upon encountering dry terrain the air bladder means 140 is again pressurized by sing a small hand pump in conjunction with a pneumatic valve incorporated into each jogger, in order to retract the pointed end of the stud means back inside outer sole 192 as illustrated in FIG. 1.

A retractable stud/spike means may have one or more spikes or studs in a manner illustrated in FIG. 4. As illustrated in FIG. 4, one row of stud/spikes have a bladder means to match. This may be modified into two or more rows of stud/spikes with a bladder to match, in a manner similar to that illustrated in FIG. 4.

While certain changes may be necessary or desirable for commercial production and marketing, and other embodiments fabricated, such changes are believed to be beyond the scope necessary to a complete disclosure of the present invention.

Since certain changes may be made without departing from the scope of the invention herein involved, it is intended that all matter contained in the above description or shown in the accompanying drawings shall be interpreted as illustrative and not in a limiting sense.

What is claimed is:

1. An athletic shoe comprising:

(a) an athletic shoe sole having an inner sole and an outer sole, said outer sole having a passsageway for a stud;

(b) a backing plate intermediate said inner sole and said outer sole, said backing plate having a plurality of studs adapted to move through said passageway in said outer sole;

(c) an air bladder intermediate said backing plate and said outer sole, said air bladder comprising a hollow tube to permit the passage of air into and out of said bladder and a plurality of sealed circular passageways closely surrounding the studs, said air bladder adapted to be pressurized and depressurized to permit movement of said studs through said passageway of said outer sole;

(d) a pneumatic valve connected to said tube and adapted to be connected to a hand pump, whereby said bladder may be pressurized and depressurized, said bladder in a pressurized configuration holding said backing plate sufficiently away from said outer sole so that the point of said studs is held entirely within said outer sole, the weight of the wearer of the athletic shoe sole with said bladder in a depressurized configuration forcing the end of said stud outboard of said outer sole.

* * * * *